US008306251B2

(12) United States Patent
Akino

(10) Patent No.: US 8,306,251 B2
(45) Date of Patent: Nov. 6, 2012

(54) NARROW DIRECTIONAL MICROPHONE

(75) Inventor: Hiroshi Akino, Machida (JP)

(73) Assignee: Kabushiki Kaisha Audio-Technica, Machida-Shi (JP)

( * ) Notice: Subject to any disclaimer, the term of this patent is extended or adjusted under 35 U.S.C. 154(b) by 69 days.

(21) Appl. No.: 12/929,482

(22) Filed: Jan. 28, 2011

(65) Prior Publication Data

US 2011/0200221 A1 Aug. 18, 2011

(30) Foreign Application Priority Data

Feb. 17, 2010 (JP) ..... 2010-032248

(51) Int. Cl.
*H04R 25/00* (2006.01)

(52) U.S. Cl. ..... 381/355; 381/356; 381/369

(58) Field of Classification Search ..... 381/355, 381/356, 357, 358, 359, 360, 361, 368, 369, 381/174, 189; 181/158
See application file for complete search history.

(56) References Cited

U.S. PATENT DOCUMENTS 4,757,546 A * 7/1988 Akino ..... 381/357
4,789,044 A * 12/1988 Akino ..... 181/158
2005/0063557 A1* 3/2005 Akino ..... 381/174

* cited by examiner

*Primary Examiner* — Huyen D Le
(74) *Attorney, Agent, or Firm* — Manabu Kanesaka

(57) ABSTRACT

There is provided a narrow directional microphone in which a microphone unit can surely be positioned coaxially in an acoustic tube, and satisfactory electrostatic shielding can be attained. In the narrow directional microphone including an acoustic tube 10 consisting of a metallic cylindrical body, and a unidirectional microphone unit 20 arranged in a rear end part 10*b* of the acoustic tube 10 with a predetermined gap A serving as a sound wave passage being provided therebetween, the narrow directional microphone further includes a unit positioning means 60 consisting of plate spring material that positions the microphone unit 20 coaxially with the acoustic tube 10 and makes the width of the gap A between the inside diameter of the acoustic tube 10 and the outside diameter of the microphone unit 20 uniform.

2 Claims, 3 Drawing Sheets

NARROW DIRECTIONAL MICROPHONE

CROSS-REFERENCE TO RELATED APPLICATION

The present application is based on, and claims priority from, Japanese Application Serial Number JP2010-32248, filed Feb. 17, 2010, the disclosure of which is hereby incorporated by reference herein in its entirety.

TECHNICAL FIELD

The present invention relates to a narrow directional microphone provided with a unidirectional microphone unit in an acoustic tube. More particularly, it relates to a technique for positioning the microphone unit coaxially with the acoustic tube.

BACKGROUND ART

The narrow directional microphone is also called a gun microphone because it has a slender acoustic tube (interference tube) the front end of which is open, having an acoustic resistance hole in the peripheral surface thereof. One example of the narrow directional microphone is explained with reference to FIGS. 3 and 4. FIG. 4 is an enlarged sectional view of a unit fixing portion shown in FIG. 3.

As shown in FIG. 3, the narrow directional microphone includes, as a basic configuration, an acoustic tube 10, a microphone unit 20, and a microphone casing 30.

The acoustic tube 10 is a cylindrical body formed of a metallic material such as aluminum, and a front end part 10*a* thereof is open. Also, sound holes 11 for introducing acoustic waves are formed in the peripheral surface of the acoustic tube 10. In this example, the sound hole 11 consists of a slit hole formed along the axis line direction of the acoustic tube 10, and, although not shown in the figure, is covered with an acoustic resistance material consisting of a nonwoven fabric or a net body.

The microphone unit 20 is a unidirectional condenser microphone unit, and houses an electrostatic acousto-electric converter. As shown in FIG. 4, the acousto-electric converter is configured so that a diaphragm and a backplate (both not shown) are arranged opposedly via a separator in a cylindrical unit casing 21 that has a front acoustic terminal 22 and a rear acoustic terminal 23 and is formed of a metallic material such as aluminum. From the rear portion of the unit casing 21, a signal output terminal 24 is pulled out.

The microphone casing 30 is a cylindrical body that is longer than the acoustic tube 10, has an inside diameter larger than the outside diameter of the acoustic tube 10, and is formed of a metallic material. The microphone casing 30 is put around the acoustic tube 10. If the acoustic tube 10 is taken as an inner tube, the microphone casing 30 is an outer tube thereof.

To a front end part 30*a* of the microphone casing 30, a front cap having a guard net or the like is attached, and in a portion on the peripheral surface of the microphone casing 30, facing the sound holes 11 of the acoustic tube 10, a large number of openings 31 each having a thin rectangular shape in this example are formed.

A cylindrical part 30*b* of the microphone casing 30 extending to the rear side beyond the acoustic tube 10 is a portion that is used as a grip. In the cylindrical part 30*b*, a circuit board 51 having a sound signal output circuit for the microphone unit 20 is housed.

Also, in the rear end part of the cylindrical part 30*b*, there is mounted an output connector 52 that is electrically connected to a phantom power source (not shown) via a balanced two-core shielded cable (not shown). The microphone casing 30 is formed with machine screw insertion holes 32*a* for fastening the output connector 52 with machine screws.

Referring to FIG. 4, the microphone unit 20 is arranged in a rear end part 10*b* of the acoustic tube 10 in such a manner that the front acoustic terminal 22 thereof is directed to the front end 10*a* side of the acoustic tube 10. For this purpose, a unit holding member 40 is used.

The unit holding member 40 includes a threadedly engaging part having internal threads 41 threadedly engaging with external threads 21*a* formed at the outer periphery of the unit casing 21, and a member base 42 having an outside diameter smaller than the inside diameter of the microphone casing 30 and projecting from the rear end of the acoustic tube 10. The member base 42 is fastened with a machine screw inserted through a machine screw insertion hole 32*b* formed in the microphone casing 30.

In the narrow directional microphone configured as described above, as described in Patent Document 1 (Japanese Patent No. 2562295), to reduce wind noise and proximity effect, a gap A serving as a low-pass filter for causing the rear acoustic terminal 23 and the front acoustic terminal 22 to communicate with each other is preferably provided between the unit casing 21 and the acoustic tube 10.

From a viewpoint of acoustic performance, the gap A is required to have a uniform width throughout the entire periphery of the unit casing 21. However, to position the microphone unit 20 coaxially with the acoustic tube 10 without producing eccentricity and tilt, a considerably high-level assembling technique is required.

Also, the unit casing 21 and the acoustic tube 10 are electrically connected to each other via the unit holding member 40, and the unit holding member 40 is fastened to the microphone casing 30 with machine screws, so that electrical continuity between these parts is difficult to secure, and electrostatic shielding is insufficient.

For this reason, if, for example, a cellular phone is used at close range and strong electromagnetic waves radiated from the cellular phone are applied to the microphone, a high-frequency current flows into the microphone unit 20, which sometimes results in the generation of noise.

Accordingly, an object of the present invention is to provide a narrow directional microphone that can surely position a microphone unit coaxially in an acoustic tube without requiring a high-level assembling technique and merely by using a low-cost and easy-to-handle part, and is also excellent in electrostatic shielding.

SUMMARY OF THE INVENTION

To achieve the above object, the present invention provides a narrow directional microphone including an acoustic tube consisting of a metallic cylindrical body, and a unidirectional microphone unit arranged in a rear end part of the acoustic tube with a predetermined gap serving as a sound wave passage being provided therebetween, wherein the narrow directional microphone further includes a unit positioning means that positions the microphone unit coaxially with the acoustic tube and makes the width of the gap between the inside diameter of the acoustic tube and the outside diameter of the microphone unit uniform.

In the present invention, preferably, the unit positioning means has a ring base plate that is arranged in a front surface peripheral edge part on the front acoustic terminal side of the microphone unit and is formed into a washer shape, and a plurality of leg pieces connectingly provided integrally with the outer peripheral edge of the ring base plate at approximately equal angular intervals in the circumferential direction and extending to the outside in the radial direction; the entire unit positioning means is formed of a metallic plate spring material; and the leg pieces are bent approximately at right angles from the outer peripheral edge of the ring base plate and are arranged in the gap.

Also, the present invention embraces a mode such that the narrow directional microphone further includes a unit holding member for holding the microphone unit in the acoustic tube and a microphone casing consisting of a metallic cylindrical body that is longer than the acoustic tube and is put around the acoustic tube; the unit holding member has a member base having an outside diameter smaller than the inside diameter of the microphone casing; and the leg pieces extend to a gap between the microphone casing and the member base.

According to the present invention, the narrow directional microphone further includes the unit positioning means that positions the microphone unit coaxially with the acoustic tube and makes the width of the gap between the inside diameter of the acoustic tube and the outside diameter of the microphone unit uniform. Thereby, the microphone unit can surely be positioned coaxially in the acoustic tube without requiring a high-level assembling technique.

Also, the configuration may be such that the unit positioning means has the ring base plate that is arranged in the front surface peripheral edge part on the front acoustic terminal side of the microphone unit and is formed into a washer shape and the plurality of leg pieces connectingly provided integrally with the outer peripheral edge of the ring base plate at approximately equal angular intervals in the circumferential direction and extending to the outside in the radial direction, and the entire unit positioning means is formed of a metallic plate spring material. Therefore, the cost is low, and the part is easy to handle.

Also, in the mode in which the narrow directional microphone further includes the unit holding member for holding the microphone unit in the acoustic tube and the microphone casing consisting of a metallic cylindrical body that is longer than the acoustic tube and is put around the acoustic tube, and the unit holding member has the member base having an outside diameter smaller than the inside diameter of the microphone casing, by extending the leg pieces to the gap between the microphone casing and the member base, the continuity between the parts is made stable, and sufficient electrostatic shielding function is accomplished.

DETAILED DESCRIPTION

Figure 2:
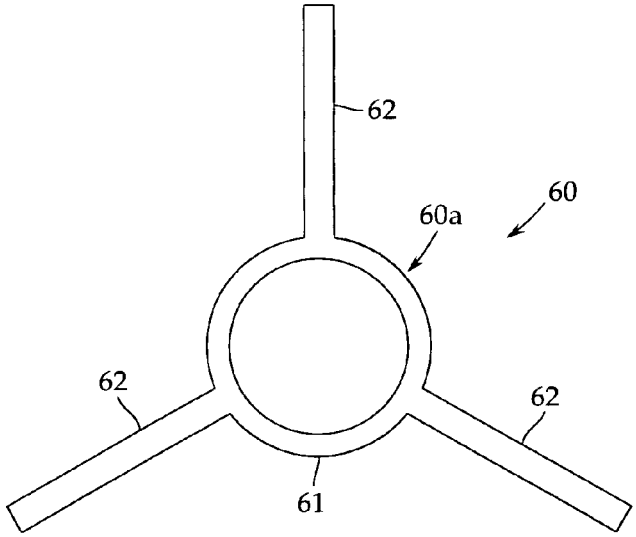
FIG. 2 is a plan view showing a preferred mode of a unit positioning means used in the present invention.
Figure 3:
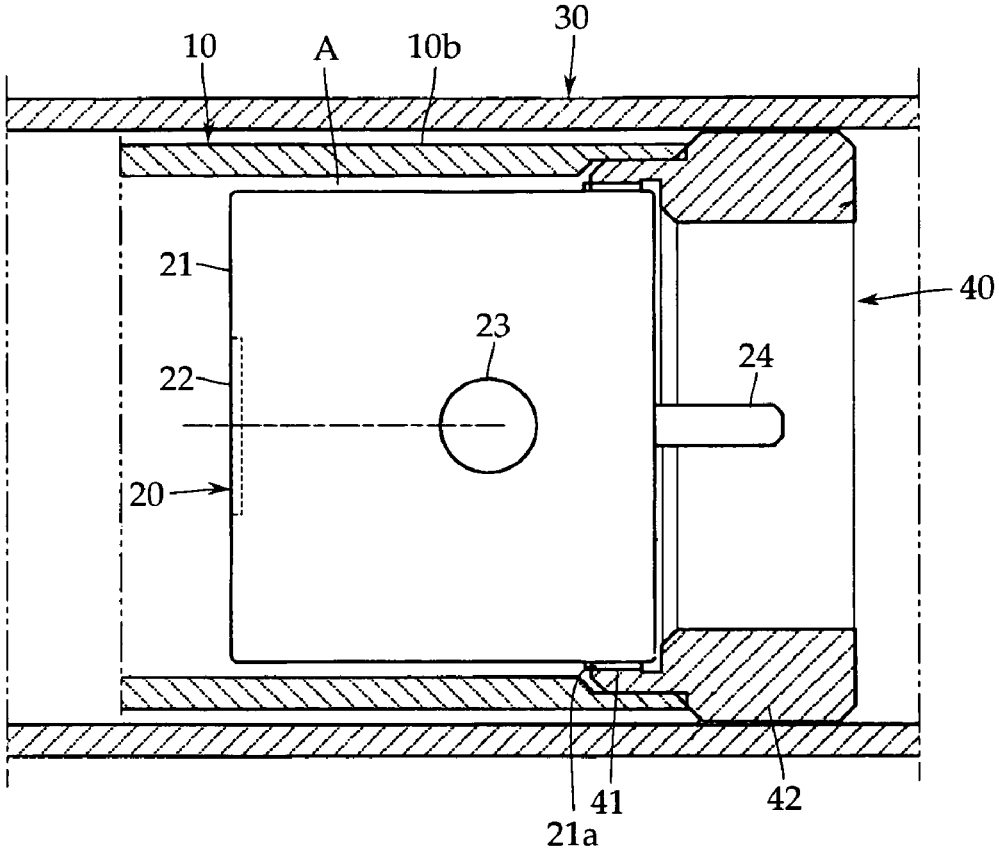
FIG. 3 RELATED ART
FIG. 3 is a sectional view of a conventional narrow directional microphone.
Figure 4:
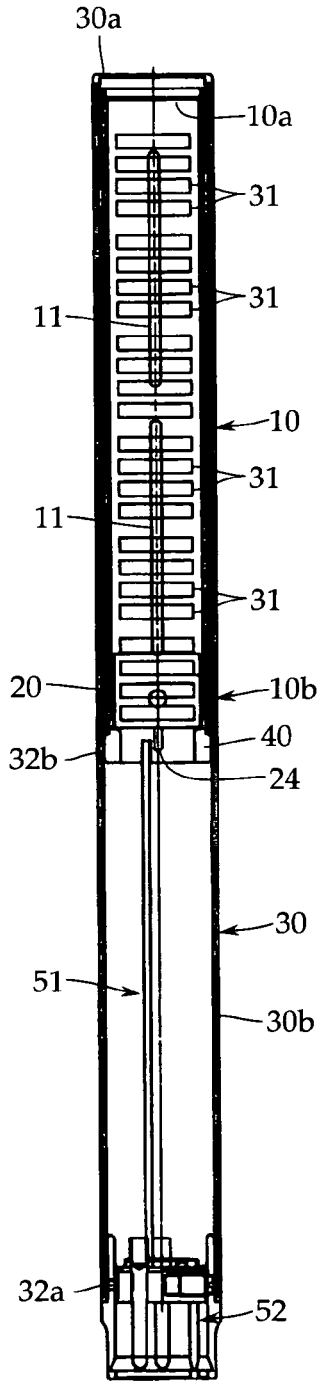
FIG. 4 RELATED ART
FIG. 4 is an enlarged sectional view showing a microphone unit mounting portion of the microphone shown in FIG. 3.

An embodiment of the present invention will now be described with reference to FIGS. 1 and 2. The present invention is not limited to this embodiment. In the description of this embodiment, the same reference numerals are applied to elements that are substantially the same as those of the conventional example explained with reference to FIGS. 3 and 4. Also, as for the configuration not shown in FIG. 1, refer to the general sectional view of FIG. 3.

Figure 1:
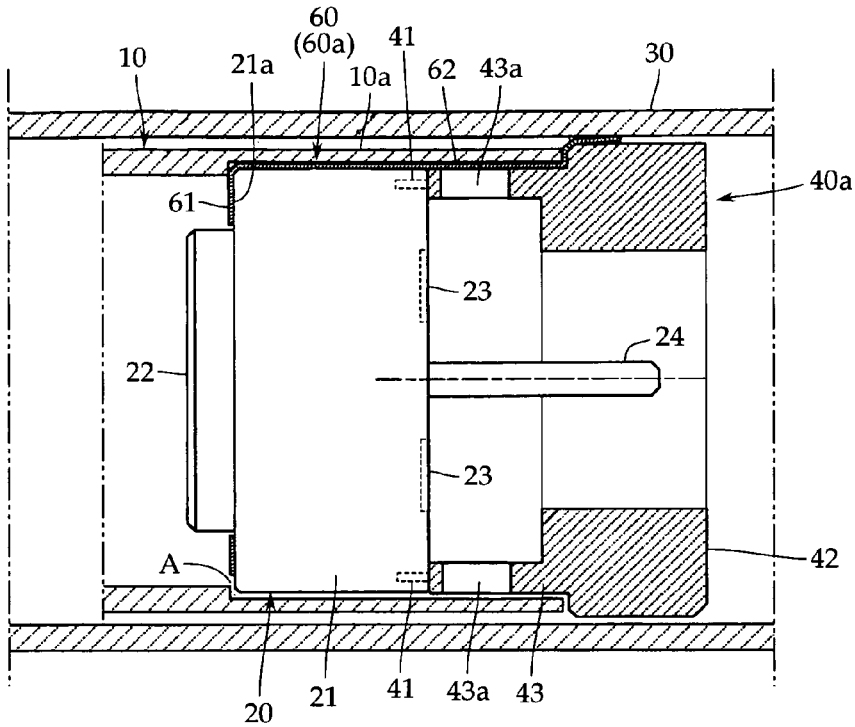
FIG. 1 is an enlarged sectional view showing an essential portion of a narrow directional microphone in accordance with the present invention.

As shown in FIG. 1, in the present invention as well, a microphone unit 20 is arranged in a rear end part 10*b* of an acoustic tube 10 in a state of being held by a unit holding member 40A. The microphone unit 20 is a unidirectional condenser microphone unit, and in this embodiment, a rear acoustic terminal 23 is provided on the bottom side of a unit casing 21.

The unit holding member 40A includes a threadedly engaging part 41 for threadedly engaging the unit holding member 40*a* with the unit casing 21, and a member base 42 having an outside diameter smaller than the inside diameter of a microphone casing 30 and projecting from the rear end of the acoustic tube 10. In this embodiment, the threadedly engaging part 41 intrudes into the unit casing 21, and has external threads threadedly engaging with internal threads, not shown, formed on the inner surface of the unit casing 21.

Also, in a shell part 43 between the threadedly engaging part 41 and the member base 42, openings 43*a* are formed. The openings 43*a* communicate with a gap A serving as a low-pass filter provided between the acoustic tube 10 and the unit casing 21.

The present invention includes a unit positioning means 60 for positioning the microphone unit 20 coaxially in the acoustic tube 10. In this embodiment, as the unit positioning means 60, a spacer 60*a* shown in FIG. 2 is used.

The spacer 60*a* has a ring base plate 61 formed into a washer shape, and a plurality of (three in this example) leg pieces 62 connectingly provided integrally with the outer peripheral edge of the ring base plate 61 and extending to the outside in the radial direction, and the entire spacer 60*a* is formed of a metallic plate spring material.

The ring base plate 61 is disposed in a front surface peripheral edge part 21*a* on the front acoustic terminal 22 side of the microphone unit 20. The three leg pieces 62 are arranged preferably at equal angular intervals of 120 degrees at the outer peripheral edge of the ring base plate 61, and the length of each of the leg pieces 62 is preferably a length extending from the front surface peripheral edge part 21*a* of the microphone unit 20 to the member base 42 of the unit holding member 40A.

The width of each of the leg pieces 62 may be determined in a range such as not to hinder the function (operation) as the low-pass filter of the gap A. As the plate spring material, a copper alloy or stainless steel material for spring having a thickness of about 0.15 to 0.2 mm is preferably used.

One example of an assembling procedure is explained. First, the unit holding member 40A is attached to the microphone unit 20. The ring base plate 61 of the spacer 60*a* is put on the front surface peripheral edge part 21*a* of the microphone unit 20, and the leg pieces 62 are bent approximately at right angles from the root thereof at the outer peripheral edge of the ring base plate 61 toward the unit holding member 40A at the rear.

The microphone unit 20 is inserted into the acoustic tube 10. After the microphone casing 30 has been put on the acoustic tube 10, the member base 42 is fastened to the microphone case 30 with a machine screw by inserting the machine screw through a machine screw insertion hole 32*b* (refer to FIG. 3).

Thereby, the leg piece 62 is extended from the gap A between the acoustic tube 10 and the microphone unit 20 to a portion between the microphone casing 30 and the member base 42 of the unit holding member 40A, so that the microphone unit 20 is positioned coaxially with the acoustic tube 10. Therefore, the gap A having a uniform width is secured around the microphone unit 20, and reliable electrical continuity is attained between the acoustic tube 10 and the microphone unit 20 and between the microphone unit 20 and the microphone casing 30.

The number of leg pieces 62 may be two or four or more. Also, the ring base plate 61 holds the leg pieces 62 until the spacer 60*a* is mounted in the microphone, and becomes unnecessary after the spacer 60*a* has been mounted in the microphone. Therefore, in place of the ring base plate 61, for example, an adhesive tape may be used to hold the leg pieces 62.

The invention claimed is:

1. A narrow directional microphone comprising:

an acoustic tube having a metallic cylindrical body;

a unidirectional microphone unit arranged in a rear end part of the acoustic tube with a predetermined gap provided therebetween as a sound wave passage; and a unit positioning means which positions the microphone unit coaxially with the acoustic tube and provides the gap uniformly between an inside diameter of the acoustic tube and an outside diameter of the microphone unit, wherein the unit positioning means has a ring base plate which is arranged in a front surface peripheral edge part on a front acoustic terminal side of the microphone unit and is formed into a washer shape, and a plurality of leg pieces connectingly provided integrally with an outer peripheral edge of the ring base plate at approximately equal angular intervals in a circumferential direction and extending in an outer radial direction;

the unit positioning means is formed of a metallic plate spring material; and the leg pieces are bent approximately at right angles from the outer peripheral edge of the ring base plate and are arranged in the gap.

2. The narrow directional microphone according to claim 1, further comprising:

a unit holding member for holding the microphone unit in the acoustic tub; and a microphone casing having a metallic cylindrical body which is longer than the acoustic tube and is put around the acoustic tube;

wherein the unit holding member has a member base having an outside diameter smaller than an inside diameter of the microphone casing and projecting from a rear end of the acoustic tube; and the leg pieces extend to a space between the microphone casing and the member base.

* * * * *